US006895673B2

(12) United States Patent
O

(10) Patent No.: US 6,895,673 B2
(45) Date of Patent: May 24, 2005

(54) HAIR CLIPPER HAVING OIL PAD

(76) Inventor: Tae Jun O, 204-3 Bupyoung-6R1, Jinjeob Eup Namyangju-shi (KR), 472-860

( * ) Notice: Subject to any disclaimer, the term of this patent is extended or adjusted under 35 U.S.C. 154(b) by 159 days.

(21) Appl. No.: 10/432,138

(22) PCT Filed: Aug. 6, 2002

(86) PCT No.: PCT/KR02/01483

§ 371 (c)(1),
(2), (4) Date: May 16, 2003

(87) PCT Pub. No.: WO03/024674

PCT Pub. Date: Mar. 27, 2003

(65) Prior Publication Data

US 2004/0025349 A1 Feb. 12, 2004

(30) Foreign Application Priority Data

Sep. 17, 2001 (KR) ..... 2001-0028579

(51) Int. Cl.[7] ..... B26B 19/40
(52) U.S. Cl. ..... 30/224; 30/123.3
(58) Field of Search ..... 30/224, 223, 123.3, 30/208

(56) References Cited

U.S. PATENT DOCUMENTS 2,271,053 A * 1/1942 Wahl ..... 30/224
6,308,415 B1 * 10/2001 Sablatschan et al. ..... 30/43.92

FOREIGN PATENT DOCUMENTS

JP 52-153571 U 11/1977
JP 60-18762 U 2/1985

* cited by examiner

*Primary Examiner*—Douglas D Watts
(74) *Attorney, Agent, or Firm*—Akerman Senterfitt

(57) ABSTRACT

A receiving groove is defined on a lower surface of a guide bracket. An oil pad is received in the groove. The guide bracket is defined adjacent to an end thereof with an oil inlet hole. A movable clipper blade is defined adjacent to front and rear ends thereof with front and rear oil passages and is positioned underneath the oil pad, such that the front and rear oil passages are communicated with oil storing grooves defined on a lower surface of the movable clipper blade, to supply oil between the movable clipper blade and a fixed clipper blade.

1 Claim, 3 Drawing Sheets

HAIR CLIPPER HAVING OIL PAD

TECHNICAL FIELD

The present invention relates to a hair clipper which has an oil pad for supplying oil to a movable clipper blade repeatedly moved leftward and rightward on a fixed clipper blade.

BACKGROUND ART

Generally, in a hair clipper, a fixed clipper blade is fastened to a body of a clipper head, and a movable clipper blade is positioned on the fixed clipper blade. As the movable clipper blade is repeatedly moved leftward and rightward by actuation of an electric motor, hair is clipped.

In order to ensure that the fixed and movable clipper blades properly clip hair, the hair clipper is used in a state wherein lubricating oil is supplied between the fixed and movable clipper blades.

However, because lubrication must be performed each time the hair clipper is used, inconvenience is caused. Also, since there are frequent occasions when the hair clipper is used without performing lubrication, an available service period of the hair clipper cannot but be shortened.

DISCLOSURE OF THE INVENTION

Accordingly, the present invention has been made in an effort to solve the problems occurring in the related art, and an object of the present invention is to provide a hair clipper in which an oil pad capable of absorbing a predetermined amount of oil is placed on a movable clipper blade in a manner such that oil can be precisely supplied between the movable clipper blade and a fixed clipper blade through oil passages defined in the movable clipper blade, thereby obviating the need for frequent lubrication and not causing inconvenience to a user.

According to the present invention, there is provided a hair clipper wherein a receiving groove is defined on a lower surface of a guide bracket; an oil pad is received in the groove; the guide bracket is defined adjacent to an end thereof with an oil inlet hole; and a movable clipper blade is defined adjacent to front and rear ends thereof with front and rear oil passages and is positioned underneath the oil pad, in a manner such that the front and rear oil passages are communicated with oil storing grooves defined on a lower surface of the movable clipper blade, to supply oil between the movable clipper blade and a fixed clipper blade.

BRIEF DESCRIPTION OF THE DRAWINGS

The above objects, and other features and advantages of the present invention will become more apparent after a reading of the following detailed description when taken in conjunction with the drawings, in which.

BEST MODE FOR CARRYING OUT THE INVENTION

Figure 1:
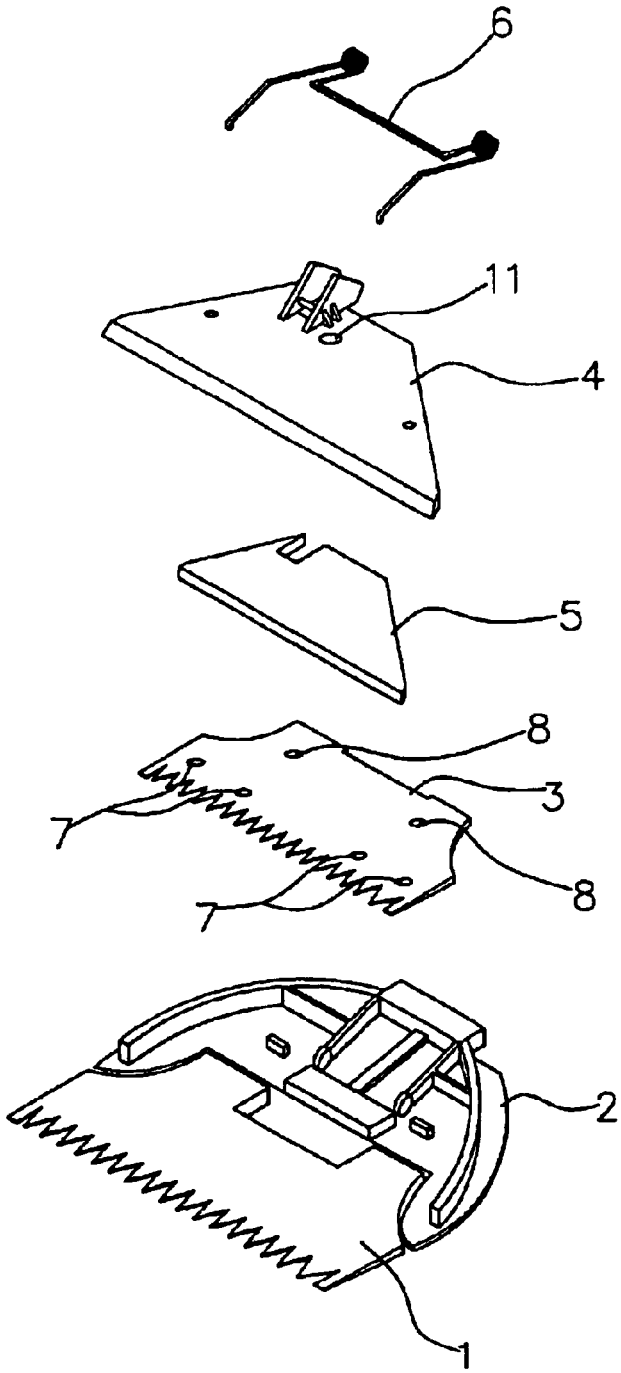
FIG. 1 is an exploded perspective view illustrating a hair clipper having an oil pad in accordance with an embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is an exploded perspective view illustrating a hair clipper having an oil pad in accordance with an embodiment of the present invention. The hair clipper according to the present invention includes a fixed clipper blade 1 and a movable clipper blade 3. The fixed clipper blade 1 is fastened to a body 2 of a clipper head. The movable clipper blade 3 is positioned on the fixed clipper blade 1.

The movable clipper blade 3 is attached to a guide bracket 4, in a manner such that the movable clipper blade 3 can be integrally moved with the guide bracket 4 when the guide bracket 4 is repeatedly reciprocated leftward and rightward via an eccentric cam driven by an electric motor (not shown).

A receiving groove is defined on a lower surface of the guide bracket 4, and an oil pad 5 such as sponge and nonwoven fabric is received in the receiving groove. The guide bracket 4 is defined adjacent to an end thereof with an oil inlet hole 11.

A torsional coil spring 6 has one end secured to the body 2 of the clipper head and the other end secured to the guide bracket 4, to squeeze the movable clipper blade 3 against the fixed clipper blade 1.

The movable clipper blade 3 is defined adjacent to front and rear ends thereof with front and rear oil passages 7 and 8 and is positioned underneath the oil pad 5.

In this preferred embodiment of the present invention, four front oil passages 7 and two rear oil passages 8 are defined through the movable clipper blade 3.

When the hair clipper according to the present invention is assembled, the movable clipper blade 3 is positioned on the fixed clipper blade 1, the movable blade 3 is attached to the guide bracket 4 to be integrally moved therewith, and the torsional coil spring 6 squeezes the movable clipper blade 3 against the fixed clipper blade 1.

Figure 2:
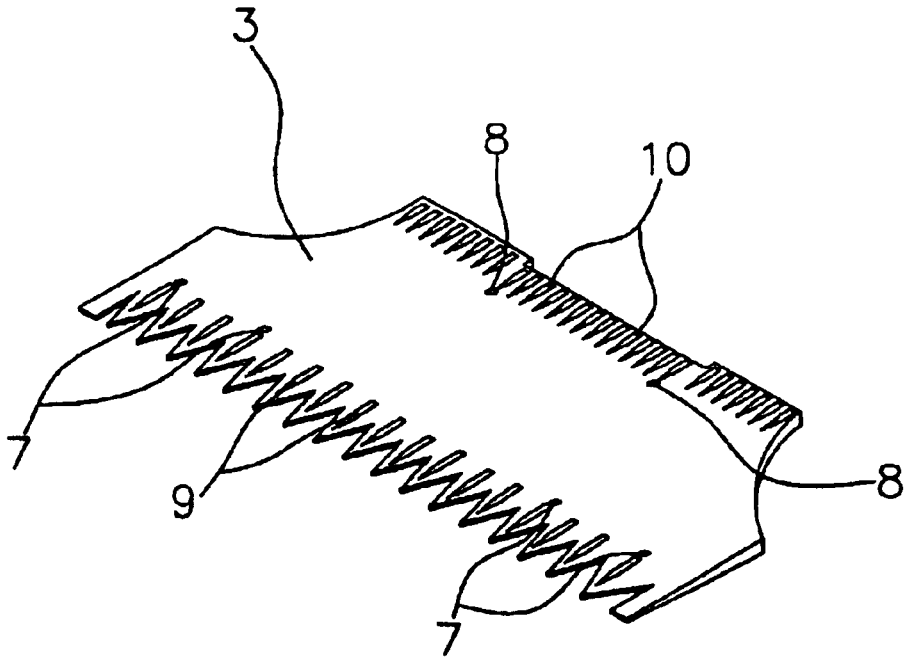
FIG. 2 is a bottom perspective view independently illustrating a movable clipper blade of the hair clipper shown in FIG. 1.

FIG. 2 is a bottom perspective view independently illustrating the movable clipper blade 3 of the hair clipper shown in FIG. 1. The movable clipper blade 3 is defined on a lower surface and adjacent to the front and rear ends thereof with a plurality of front and rear oil storing grooves 9 and 10.

The front oil passages 7 are respectively communicated with four of the front oil storing grooves 9, and the rear oil passages 8 are respectively communicated with two of the rear oil storing grooves 10, to allow oil to be supplied between the fixed and movable clipper blades 1 and 3.

Figure 3:
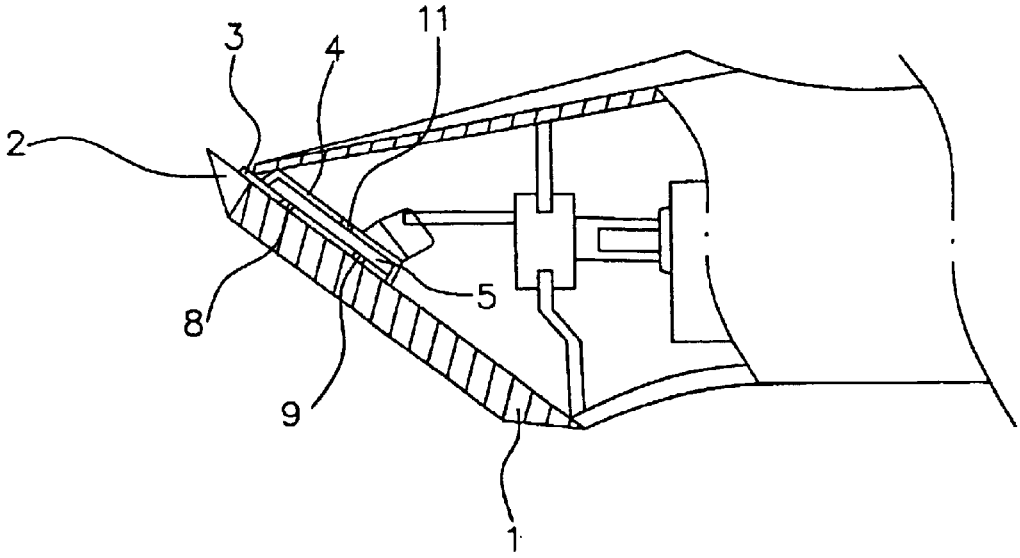
FIG. 3 is a cross-sectional view illustrating an assembled state of the hair clipper according to the present invention.

FIG. 3 is a cross-sectional view illustrating an assembled state of the hair clipper according to the present invention. The guide bracket 4 is connected to the eccentric shaft of the electric motor. By rotation of the electric motor, the guide bracket 4 and the movable clipper blade 3 are integrally moved leftward and rightward.

Accordingly, in the hair clipper according to the present invention, when the movable clipper blade 3 is moved on the fixed clipper blade 1, oil is supplied between the fixed and movable clipper blades 1 and 3 from the oil pad 5 placed on the movable clipper blade 3 through the front and rear oil passages 7 and 8 of the movable clipper blade 3, whereby friction between the fixed and movable clipper blades 1 and 3 can be minimized while the hair clipper is operated.

Also, due to the fact that the oil pad 5 can absorb a predetermined amount of oil, since oil can be used for an extended period of time through single lubrication, the need for frequent lubrication is obviated and inconvenience is not caused to a user.

INDUSTRIAL APPLICABILITY

As apparent from the above description, the hair clipper having an oil pad according to the present invention provides advantages in that, since the oil pad is received in a guide bracket positioned above a movable clipper blade, oil can be used for an extended period of time through single lubrication. Also, as oil is precisely supplied between the movable clipper blade and a fixed clipper blade, friction between the fixed and movable clipper blades can be minimized, and an available service period of the hair clipper can be lengthened.

What is claimed is:

1. A hair clipper comprising:

a fixed clipper blade fastened to a body of a clipper head;

a movable clipper blade positioned on the fixed clipper blade, defined on a lower surface thereof with a plurality of oil storing grooves, and attached to a guide bracket;

a torsional coil spring having one end secured to the body of the clipper head and the other end secured to the guide bracket, for squeezing the movable clipper blade against the fixed clipper blade;

wherein a receiving groove is defined on a lower surface of the guide bracket; an oil pad is received in the receiving groove; the guide bracket is defined adjacent to an end thereof with an oil inlet hole; and the movable clipper blade is defined adjacent to front and rear ends thereof with front and rear oil passages and is positioned underneath the oil pad, in a manner such that the front and rear oil passages are communicated with the oil storing grooves of the movable clipper blade, to supply oil between the movable clipper blade and a fixed clipper blade.

* * * * *